US005988064A

United States Patent [19]

Deneka

[11] Patent Number: 5,988,064

[45] Date of Patent: Nov. 23, 1999

[54] PRINTING COATING HEAD DEVICE

[76] Inventor: P. Kenneth Deneka, 243 Provinceline Rd., Allentown, N.J. 08501

[21] Appl. No.: 09/040,209

[22] Filed: Mar. 17, 1998

Related U.S. Application Data

[63] Continuation of application No. 08/544,844, Oct. 18, 1995, Pat. No. 5,826,509.

[51] Int. Cl.[6] ..... B41F 31/08; B41F 31/04

[52] U.S. Cl. ..... 101/366

[58] Field of Search ..... 101/350, 366, 101/363, 364, 207–210, 157, 158, 169; 118/259, 261

[56] References Cited

U.S. PATENT DOCUMENTS

| | | | |
|---|---|---|---|
| 2,377,110 | 5/1945 | Smith | 101/157 |
| 3,160,094 | 12/1964 | Bean | 101/181 |
| 3,210,826 | 10/1965 | Connelly | 29/129 |
| 3,776,133 | 12/1973 | Ritzerfeld | 101/147 |
| 3,793,952 | 2/1974 | Neumann et al. | 101/157 |
| 4,057,012 | 11/1977 | Heidemann | 101/153 |
| 4,089,265 | 5/1978 | White et al. | 101/357 |
| 4,362,104 | 12/1982 | Imai et al. | 101/34 |
| 4,413,560 | 11/1983 | Rogge | 101/247 |
| 4,499,826 | 2/1985 | Regge | 101/181 |
| 4,602,562 | 7/1986 | Ottenhues et al. | 101/182 |
| 4,727,806 | 3/1988 | Green, Sr. | 101/415.1 |
| 4,796,528 | 1/1989 | Sarazen | 101/208 |
| 4,958,561 | 9/1990 | Grosshauserf et al. | 101/363 |
| 4,998,474 | 3/1991 | Hauer | 101/366 |
| 5,010,817 | 4/1991 | Grosshauser | 101/350 |
| 5,039,378 | 8/1991 | Pommier et al. | 162/128 |
| 5,054,392 | 10/1991 | Greenwood | 101/142 |
| 5,081,928 | 1/1992 | Harrison | 101/351 |
| 5,181,471 | 1/1993 | Sillars | 101/483 |
| 5,239,924 | 8/1993 | Wallmann et al. | 101/179 |
| 5,239,925 | 8/1993 | Bobo | 101/366 |
| 5,243,907 | 9/1993 | Weishew | 101/208 |
| 5,279,697 | 1/1994 | Peterson et al. | 156/358 |
| 5,370,622 | 12/1994 | Livingston et al. | 604/151 |
| 5,497,702 | 3/1996 | Gorter | 101/366 |

*Primary Examiner*—J. Reed Fisher
*Attorney, Agent, or Firm*—Paul & Paul

[57] ABSTRACT

A coating head device for coating an engraved surface on a coating cylinder of a printing press having a main body with a longitudinal cavity for liquid, open to the coating cylinder and substantially sealable to the coating cylinder. The cavity has an injection zone providing for a zone pressurizing the liquid within a portion of said cavity in the main body to compel liquid into cells in the engraved surface of the coating cylinder. The main body has an inlet to provide liquid to the supply chamber and a return to exhaust liquid from the outlet section.

15 Claims, 5 Drawing Sheets

PRINTING COATING HEAD DEVICE

This application is a continuation of application Ser. No. 08/544,844, filed Oct. 18, 1995 now U.S. Pat. No. 5,826, 509.

BACKGROUND OF THE INVENTION

This invention pertains to the art of printing and printing presses and more particularly to an improvement in a printing press having a new and improved device for supplying ink or other liquid to a coating cylinder.

Food packaging, cartons, containers, periodicals, newspapers, and other like items are commonly printed by means of flexographic or gravure roll printing presses. Materials used in some of these applications are constructed of multiple layers which are laminated using adhesives and coatings applied by gravure roll application. Devices in current use to supply ink or adhesive or coating to a coating cylinder in such a press or coater/laminator, or the like, typically have a metal body to which clamps are used to hold in place flexible thin blades which contact the surface of the coating cylinder over its entire length. With the length of the prior coating head device oriented along the long center line axis of the coating cylinder, the flexible blades form a liquid seal in the axial direction. At the ends of the device are seals cut to an appropriate shape and clamped at the end to form a liquid seal at each end of the device. The device is then pressed to the radial surface of the coating cylinder and a liquid seal is achieved. These prior devices have what are known generically in the art as a dual enclosed doctor blade system. A dual enclosed doctor blade system typically has two or more flexible blades, end seals and use a means to circulate liquid through the device. However, these prior inking devices typically use a print ink head having only a single zone internal cavity.

The principal object of the present invention is to provide a printing press using a coating head device having a dual enclosed doctor blade system having a three-zone internal cavity that improves the liquid flow to a coating cylinder to which liquid is supplied.

SUMMARY OF THE INVENTION

This invention relates to a printing press and coating head device such that ink or other liquid can be supplied to a coating cylinder, to which the liquid is supplied, in a superior manner to those in use prior to the present invention. More particularly, the invention is concerned with a printing press utilizing a coating head device having dual enclosed doctor blades and an internal ink cavity divided into three distinct zones rather than a single internal cavity.

The coating head device for a printing press apparatus of this invention comprises a main body with a longitudinal cavity for liquid, open to the coating cylinder and substantially sealable to the coating cylinder. The cavity has a unique injection zone providing for a zone pressurizing the liquid within a portion of the cavity in the main body to compel liquid into cells in the engraved surface of the coating cylinder. The main body has an inlet to provide liquid to the supply chamber and a return to exhaust liquid from the outlet section.

It is accordingly an object of the present invention to provide a new and improved coating head device.

It is another object of the present invention to provide a new and improved coating head device that contains liquids in use in a substantially closed system.

It is another object of the present invention to provide a new and improved coating head device that suppresses foam created during the printing process.

It is another object of the present invention to provide a new and improved coating head device that maintains color value over a wide range of printing speeds.

It is another object of the present invention to provide a new and improved coating head device that has a small internal volume such that less ink or solvent is used in the printing process.

It is another object of the present invention to provide a new and improved coating head device that has a small internal volume such that liquid residence time in the coating head is reduced, thus, reducing the opportunity for foam development.

It is another object of the present invention to provide a new and improved coating head device that exchanges substantially all the coating on the coating cylinder roll to which ink may be supplied, such that the ink on the engraved roll is always fresh and the coating cylinder does not become tacky or dry.

It is another object of the present invention to provide a new and improved coating head device that decreases the need for scrubbing the coating cylinder to clean out dried ink.

It is another object of the present invention to provide a new and improved coating head device that is easily and quickly cleaned.

It is another object of the present invention to provide a new and improved coating head device that allows the coating cylinder to be easily and quickly cleaned.

It is another object of the present invention to provide a new and improved coating head device that reduces evaporative losses of liquids.

It is another object of the present invention to provide a new and improved coating head device that greatly reduces the amount of solvents required for cleanup such that hazardous waste generation is reduced.

It is another object of the present invention to provide a new and improved coating head device that allows for its doctor blades to be easily and quickly replaced.

It is another object of the present invention to provide a new and improved coating head device having end seals that require replacement on a less frequent basis than prior end seals.

It is another object of the present invention to provide a new and improved printing press utilizing the improved coating head device having all or the objects and advantages as listed above.

Other objects and advantages of the present invention will become apparent from the following description taken in conjunction with the accompanying drawings.

DESCRIPTION OF THE PREFERRED EMBODIMENT

Figure 1:
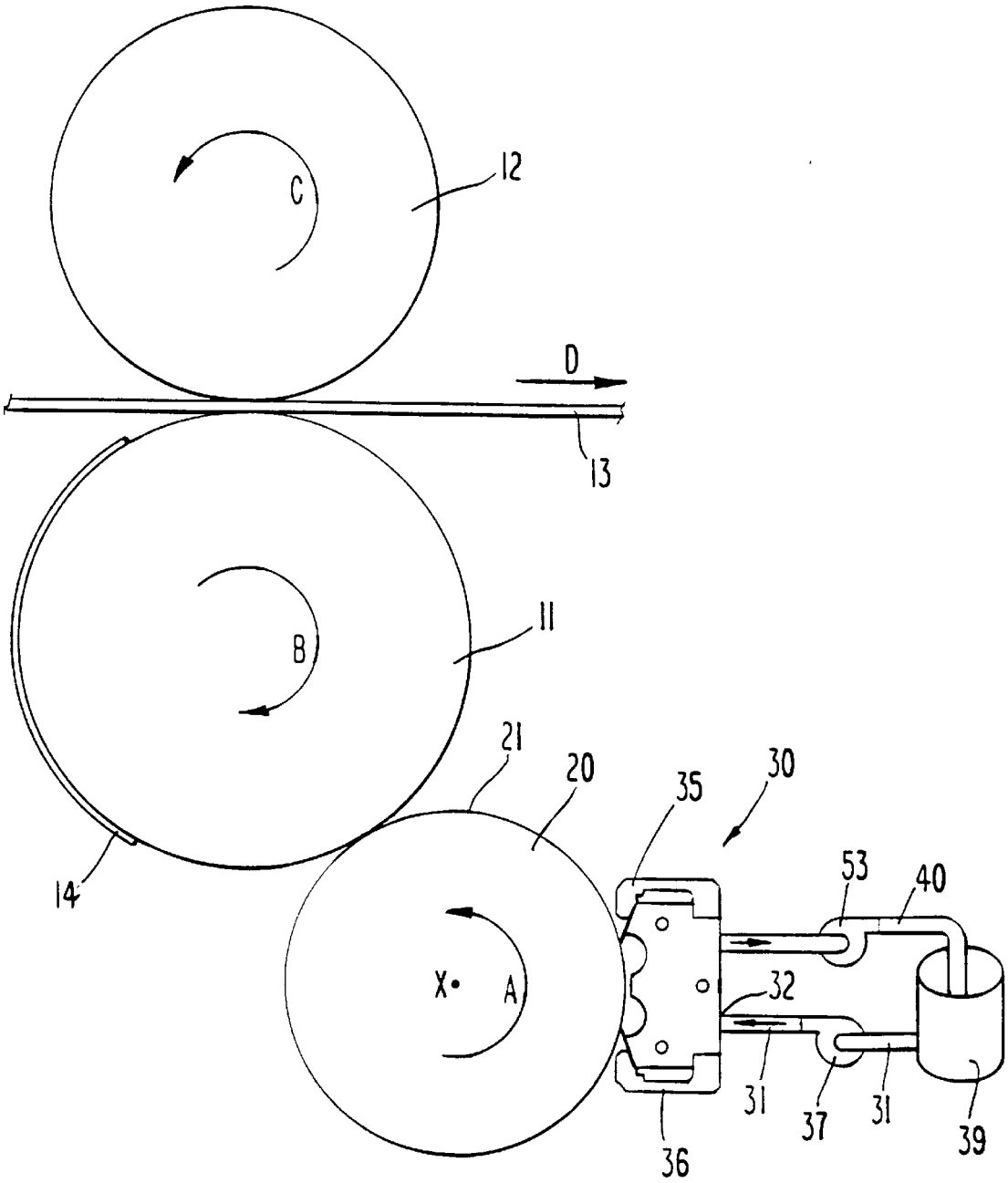
FIG. 1 is a simplified side elevational view of a printing press in accordance with one preferred embodiment of the present invention.

Referring now in detail to the drawings, wherein like reference numerals indicate like elements throughout the several views, there is shown in FIG. 1, a printing station 10 in accordance with a preferred embodiment of the present invention in simplified form. The printing station 10 of the present invention may be a conventional flexographic printing station, or any other printing station wherein a coating head 30 is used in conjunction with an anilox roll, gravure cylinder, or other ink applicator roll, hereinafter referred to as coating cylinder 20. As seen in FIG. 1, a conventional flexographic printing station has a printing cylinder 11 (or plate cylinder) and a backing cylinder 12 between which sheets of, or continuous roll fed substrate, for example, paper 13, are sequentially advanced. A printing plate 14 is mounted on the printing cylinder, for example, by vacuum. As can be seen in FIG. 1, as coating cylinder rotates in direction A, the coating head device 30 applies a liquid such as ink to the coating cylinder 20 which has an engraved surface 21 (see FIG. 3). Preferably, the coating head device is installed on the printing press at either the 3:00 or 9:00 positions. The ink or other liquid is provided to cells 22 in the engraved surface 21 of the coating cylinder 20 for holding liquid to be transferred to the printing plate 14 (see FIG. 3). The ink is supplied to the coating cylinder 20 by the coating head device 30 of the current invention. The ink or other liquid is supplied to the coating head device 30 from ink drum 39 through liquid supply pipe 31 to inlet orifice 32 of the coating head device 30. Although this description generally refers to the liquid utilized as being ink, any liquid having generally Newtonian properties may be used.

Figure 3:
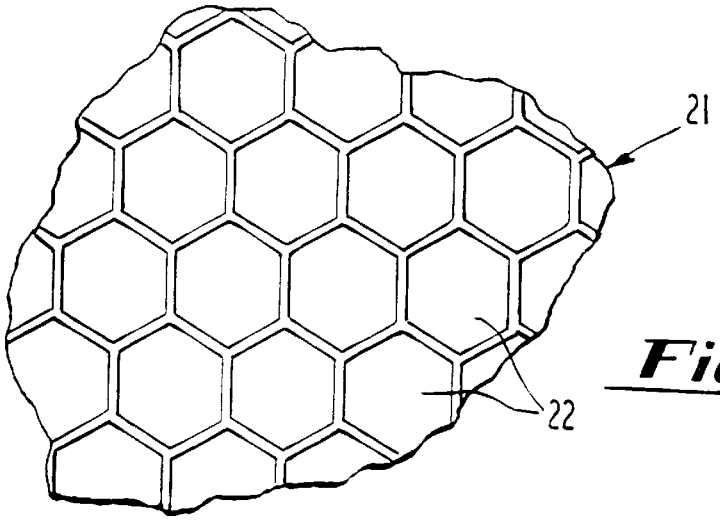
FIG. 3 is a partial magnified view of the engraved surface of a coating cylinder as used in the printing press of FIG. 1.

Coating cylinders 20 with different engraved surfaces 21 (also called surface screens) are available, e.g. surfaces formed with small pyramids, or quadrangles, or hexagonal shapes, or having channels therein, etc. The present invention will operate under a wide variety of these surfaces. These different engraved coating cylinders may provide different printing qualities. In the preferred embodiment, as seen in FIGS. 1 and 3, the engraved surface 21 is of a hexagonal configuration. These engraved surfaces may be, for example, laser engraved at, for example 700 lines per lineal inch. The surface may also be chrome plated to provide for corrosion resistance.

FIG. 1 depicts a vertical section through the printing station 10 and shows a preferred arrangement of the main relevant operating elements required for the present invention. This printing station 10 may also incorporate other elements known in the art for performing other operations such as, for example, cutting, creasing, etc.

At the top is a backing cylinder 12 which cooperates with a printing cylinder 11 having mounted thereon printing plate 14. The cylinders 20 and 11 rotate respectively in the direction of arrows A and B to feed the sheet 13 therebetween in the direction of the arrow D with the sheet 13 being printed on the underside thereof. The coating cylinder 20 is rotated counterclockwise in the direction of the arrow A and inks the printing plate 14. Ink is supplied to the surface of the coating cylinder 20 via the coating head device 30 of the current invention.

Figure 2:
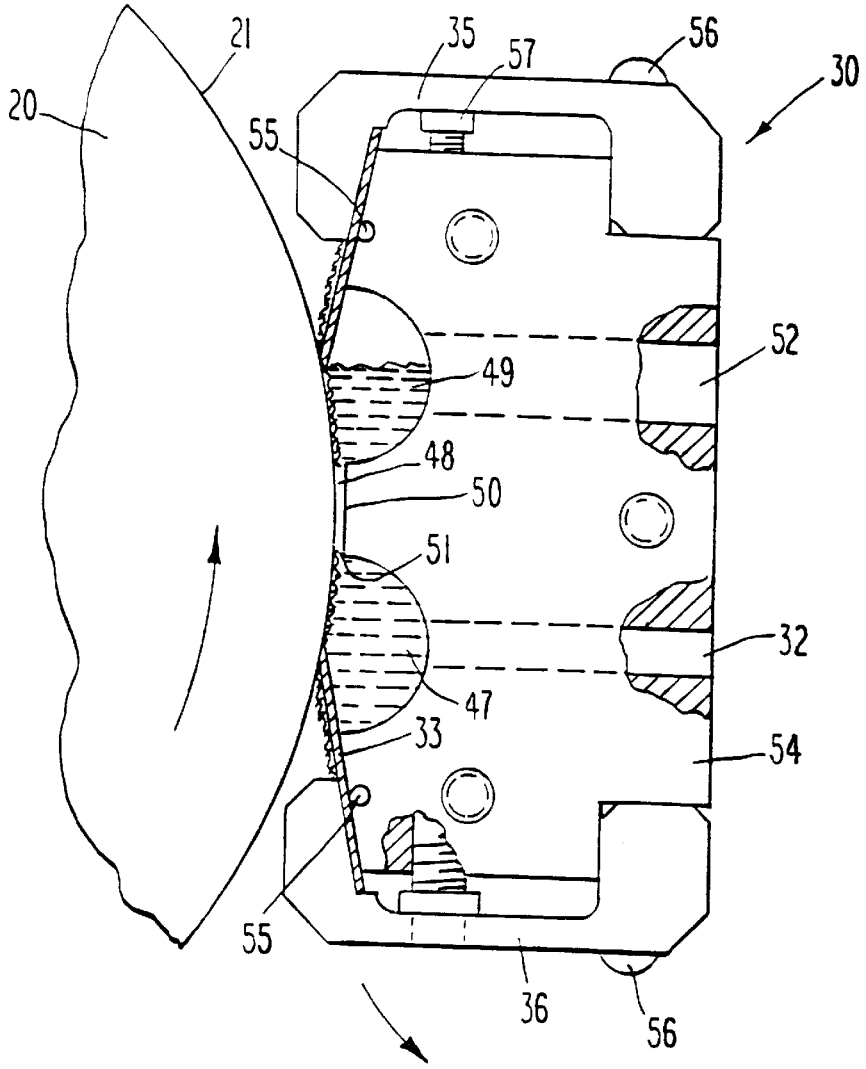
FIG. 2 is a side elevational view, partially cutaway of the printing press of FIG. 1 with a seal plate removed.

The coating head device 30 employs a unique twin-chamber, three zone configuration that flushes air from the coating cylinder cells 22 and fully charges each cell 22 with ink or other liquid, yielding a metered, precise coating weight of ink transfer on every rotation. As can be seen in FIGS. 1 and 2, a lead doctor blade 33 clears the coating cylinder surface 21 and breaks the boundary layer of air that impedes cell-filling in prior coating pan systems. Liquid is substantially contained within the coating head device 30 and associated tubing 31, 40 (partially shown in FIG. 1), pumps 35 (partially shown in FIG. 1), and recirculation container.

The coating head device 30 has a main body 54 of, for example, aluminum, to which are bolted two clamps 35, 36 by bolts 56. The clamps 35, 36 each hold in place flexible thin doctor blades 33, 34 which, when properly positioned, contact the engraved surface 21 of the coating cylinder 20 over substantially its entire length. O-ring seals 55 may be used to further seal the doctor blades 33, 34 to the main body 54 of the coating head device 30. The length of the coating head device 30 is oriented along the axial center axis X of the coating cylinder 20, thus the flexible blades 33, 34 form a liquid seal. Other materials can be used for the main body of the coating head device 30 such as stainless steel, and, additionally, the material can be plated or anodized to reduce corrosion.

Figure 4:
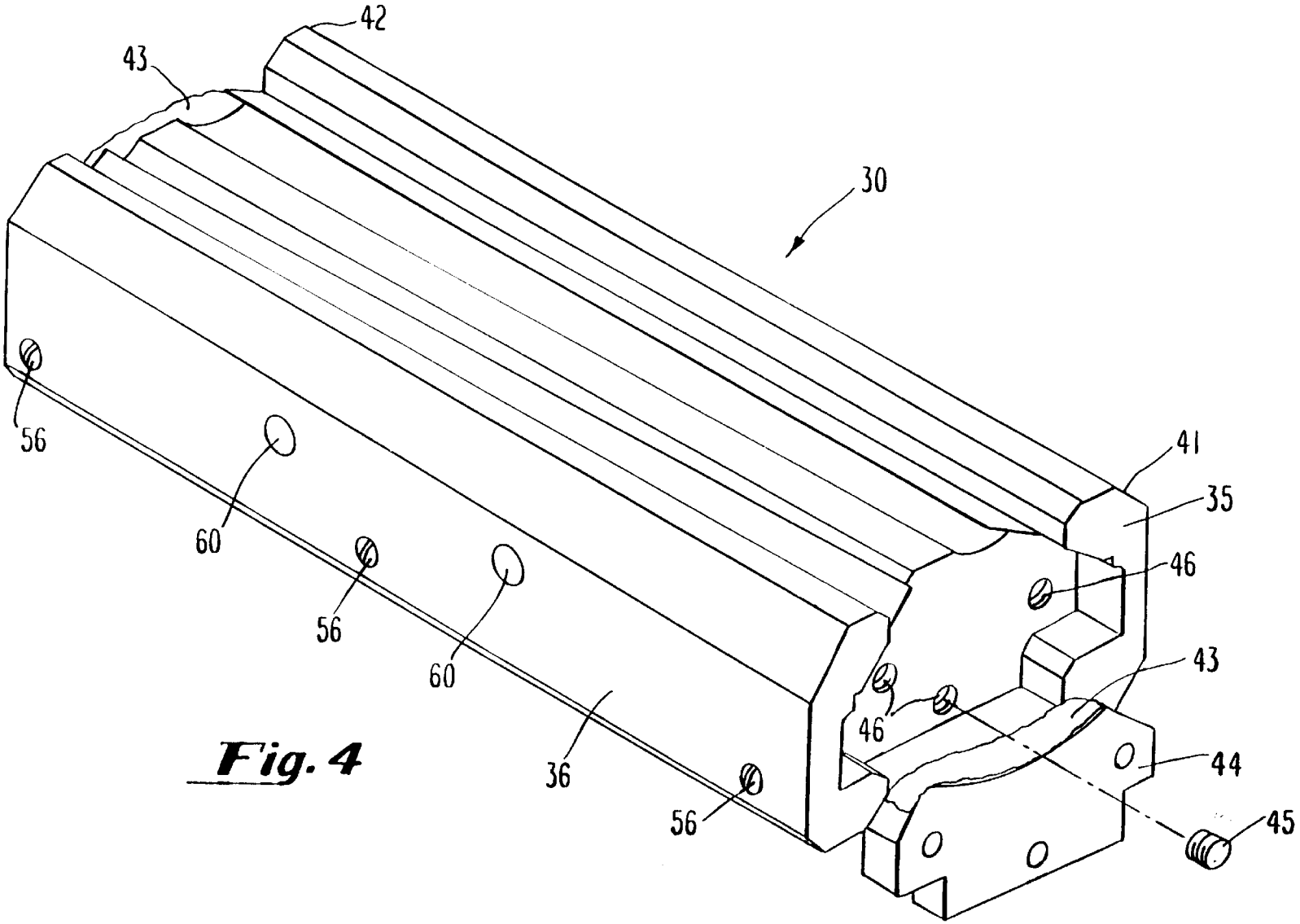
FIG. 4 is a perspective view of a coating head device as used in the printing press of FIG. 1, depicted in partially exploded form.

As can be seen in FIG. 4, at each end 41, 42 of the coating head device 30 is a seal 43 made of plastic or rubber foam or fabric felt cut to appropriate shape and clamped at the end with seal plate 44, with, for example, screws 45 into threaded holes 46 to form a liquid seal at each end of the coating head device 30. Preferably, 100% natural wool seals are used, saturated in petroleum jelly due to the enhanced abrasion characteristics of the wool, and the fact that the petroleum jelly is generally not soluble using any routine liquid used in the printing industry.

As can be seen in FIGS. 1 and 2, in operation, the coating head device 30 is pressed to the engraved surface 21 of the coating cylinder 20 and a substantially full liquid seal is achieved. Thus, the coating head device 30 can be brought into alignment with the coating cylinder 20 under a minimum amount of pressure, whereby doctor blades 33, 34 require replacement on a significantly reduced basis. Prior users often used polyester felt in combination with 50 weight gear oil, with the associated problems of fibers of polyester tracking through print and dissolving of the gear oil by solvent-based inks and coating solutions and by many solutions for cleaning used, thereby contaminating the inks or solutions.

Figure 5:
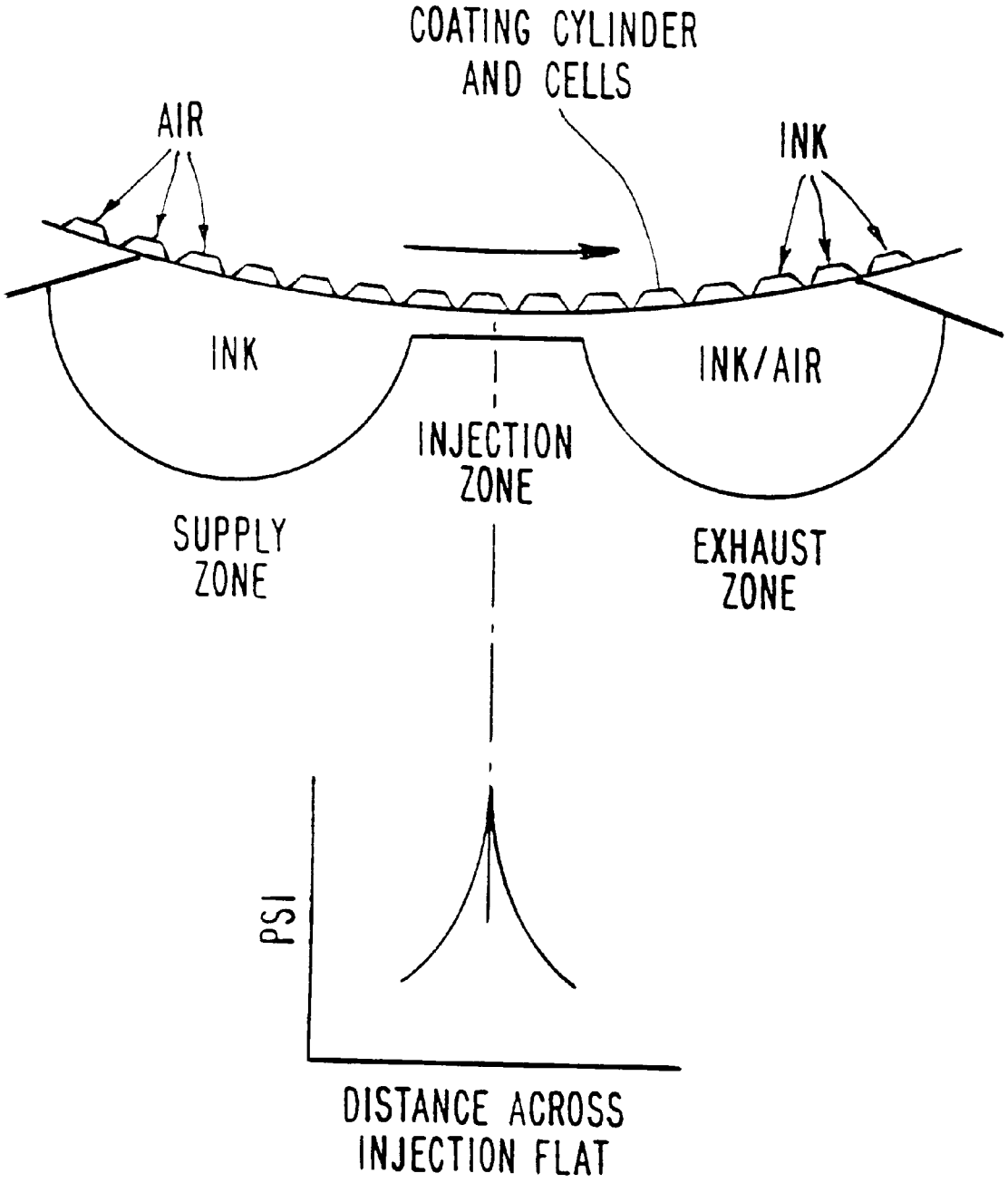
FIG. 5 is a schematic of the action of the coating head device as used on the printing press of FIG. 1.
Figure 6:
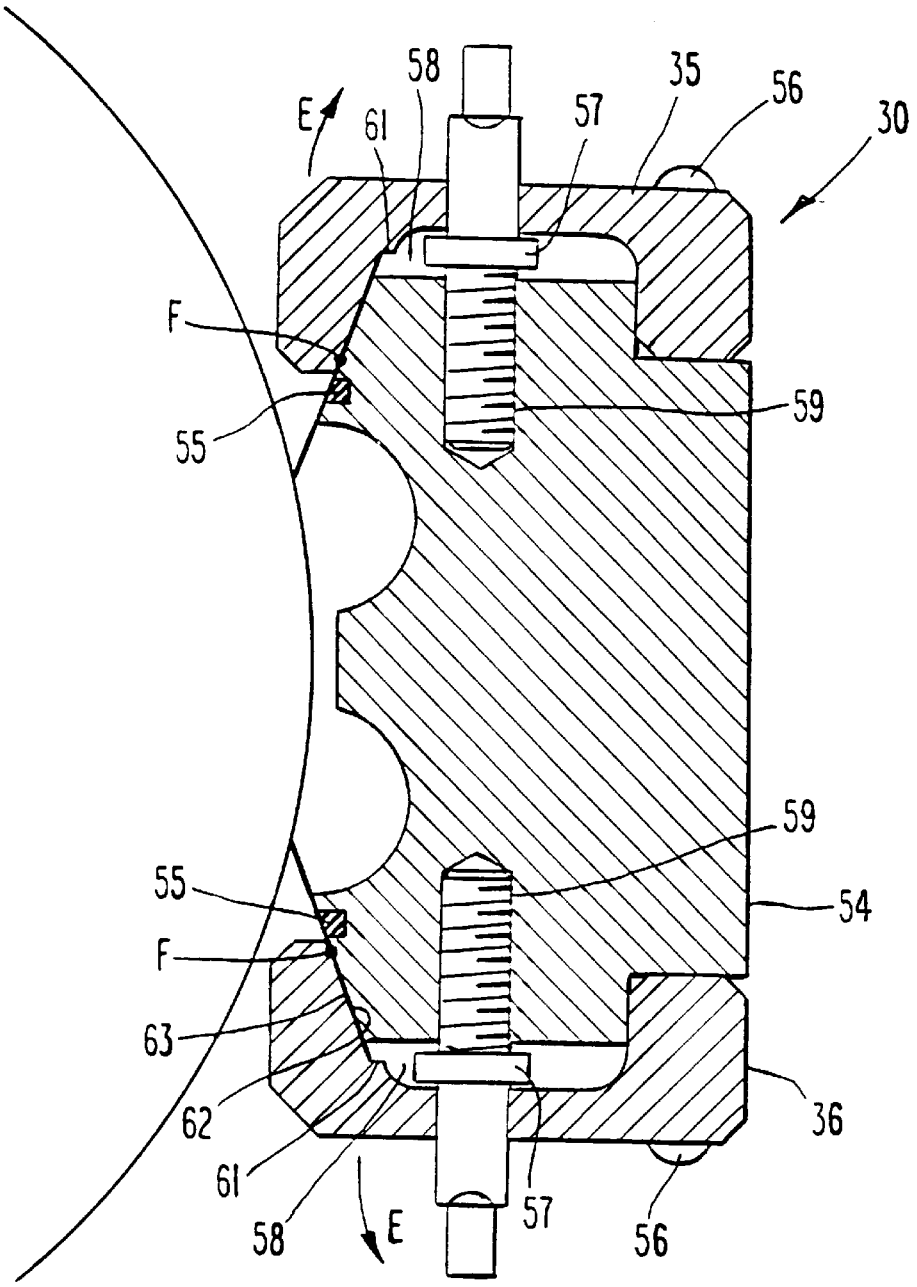
FIG. 6 is a cross-sectional side view a coating head device as used in the printing press of FIG. 1, depicting doctor blade clamping means.

As can be seen in FIG. 2 and in schematic in FIG. 5, in operation of a printing press utilizing the elements of the present invention, ink or other liquid is fed in under constant pressure by supply pump 37 through supply tubing 31 through inlet orifice 32 of coating head device 30 into the supply chamber 47, i.e. the lower chamber, in the coating head device 30, and floods the engraved surface 21 of cells 22 of the coating cylinder 20 where the coating head device 30 makes contact with the coating cylinder 20. The formation of bubbles or foam within the supply chamber 47 is inhibited due to the fragility of the bubble walls when place under the pressure of the ink or other liquid pumped in. Here, the entire supply chamber 47 is filled with liquid, as can be seen in FIG. 2.

Pressurized ink is then forced into the injection zone 48, a narrow passageway between the supply chamber 47 and the exhaust/return chamber 49 (to be described in detail hereinafter). The ink is forced by pressure of the supply pump 37 induced flow. Pressure of liquid passing through the injection zone, in the center 50 of the injection zone, spikes upward due the slight narrowing of the gap 51 due to the flat section of the injection zone 48 located on the coating head device 20 in relation to the radius of the coating cylinder 20. That is, the cross-sectional area of the injection zone 48 is least at the center point 50 of the injection zone. For ink, this gap is preferably approximately 0.140 to 0.150 inches at its narrowest point, depending on the diameter of the coating cylinder 20. Since the pressure in zone 48 spikes upward, ink is forced into the deepest recesses of every cell 22 in the coating cylinder 20. Moreover, trapped air is forced out of the liquid and into the exhaust/return chamber 49. Exhaust/return chamber 49 is partially filled with liquid and partially filled with air, as can also be seen in FIG. 2. Thus, substantially no air is left in the bottom of the cells 22, allowing for full-cell charging. Coating weights are therefore precisely metered, advantageously providing for more uniform color crisper and cleaner print definition throughout a print run.

The number of inlet orifices 32 in coating head device 30 may vary depending on the axial length of the cylinders. For example, one inlet orifice 32 every thirty inches may be used with associated pumps, tubing and the like. Using liquids such as inks that have higher viscosities, for example, one inlet orifice v Finally, the liquid used.

Finally, the liquid and air enter the exhaust/return chamber 49. Outlet orifice 52 is larger in cross-section than inlet orifice 32, for example fifteen to twenty percent greater, to allow for reduced pressure and to allow for both liquid and air to escape and be pumped out by return pump 53 through tubing 40. The trailing doctor blade 34 knifes way residual ink or coating as the coating cylinder 20 rotates. Excess ink or other liquid is captured in the exhaust/return chamber 49, along with the exhaust air flushed from the cylinder cells. Substantially, only the ink or coating in each fully charged cell remains.

Supply chamber 47 and exhaust chamber 49 are preferably half-circular in cross section as can be seen in FIGS. 1 and 2, however, many cross-sectional shapes will operate properly.

Foaming, frothing, or bubbling of the liquid is undesirable in that it can cause washed-out colors or inconsistent coating weight, particularly in water-based systems. The coating head of the present invention uses the injection zone 48 to force ink or coating to the bottom of every cell 22 on the engraved surface 21 of the coating cylinder 20, forcing trapped air out and fully charging every cell. Also, by eliminating boundary air by the lead doctor blade 33 before the portion of the engraved surface 21 of the coating cylinder 20 enters the coating head device 30, the coating head device 30 prevents aeration of ink or liquid and substantially reduces evaporation of water or solvents. Solids in the ink or coating remain in suspension, at the proper proportions, to provide for consistent coating weights. Color shifting is minimized because solvent or water evaporation is minimized. The need to add make-up water or solvent is therefore also minimized.

In coating and printing systems, cell "dwell time" in the coating medium is reduced as a result of increased coating cylinder 20 rotational speed. The boundary layer of air that forms around the coating cylinder 20 as it turns, is particularly apparent as rotational speeds are increased. In prior art devices, this boundary layer typically compresses at the engraved surface 21 of the coating cylinder 20, hampering coating, ink or other liquid from filling cells 22. In prior single chamber systems, the boundary layer is broken by a doctor blade, but there is not sufficient pressure from the supply chamber to overcome and displace air trapped in the bottom of each cell. In the present invention, pressure at the center 50 of the injection zone 48 builds with increased rotational speed, creating a stream of increasingly pressurized ink. Substantially every cell 22 is fully charged, even at high rotational speeds.

DOCTOR BLADE CHANGEOVER

Also, a unique method of mounting the doctor blades 33, 34 used with the coating head device 30 of the present invention substantially reduces the time and energy required to change and align the blades 33, 34. As seen in FIGS. 1, 2, 4, and 6, the unique arrangement of blade clamps 35, 36 provides for quick and easy removal, installation, and alignment of doctor blades 33, 34 installed in the coating head device 30. As seen in cross-section in FIG. 6, clamps 35, 36 are bolted to the main body 54 of the coating head device 30 using bolts 56. Specially designed leveraging bolts 57 are designed to fit in threaded holes 59 in the main body 54 of the coating head device 30. The heads of leveraging bolts 57 are each located in a cavity 58 between each clamp 35, 36. Access to the leveraging bolts 57 is obtained through holes 60 in clamps 35, 36. Leveraging bolts 57 may be installed, for example every eight inches for each clamp 35, 36. By slightly unbolting leveraging bolts 57 on one side of coating head device 30, a respective clamp 35, 36, held in position by bolts 56, is deflected outward slightly in the direction of arcs E. Thus, pressure is taken off the respective doctor blade 33, 34 and may be easily removed. When reinstalling a new doctor blade 33, 34, a new blade is placed into the open slot created by the deflected clamp until it bottoms out on groove 61. Since the blades are typically only 0.006 to 0.034 inches thick only slight deflection of the clamps 36, 37 are required. To ensure proper clamping of the blades 33, 34, a 0.001 inch interference fit of at point F is desirable prior to installation of a blade 33, 34, thus, when doctor blades 33, 34 are properly installed, clamps 36, 37 deflect slightly, creating a high pressure vise point at F due to the 0.011 inch total interference fit created. Walls 62 and 63 converge slightly to create the high pressure vise point at point F.

COATING CYLINDER CLEANING

Additionally, the present invention provides a highly efficient self-cleaning feature. By transferring the liquid supply pipe 31 from the ink drum 39 to a clean-up solvent drum (not shown) or water drum (not shown), the system can be run for a short period of time, as it is done with ink, with solvent or water to clean the coating cylinder 20. Since no separate scrubbing operation is required due to the particularly thorough cleansing operation as optimized by the high pressure injection zone 48, substantially less cleaning solvent may be used, thus, significantly reducing expenses incurred on hazardous waste disposal. Typically, efficient cleaning of the coating cylinders may occur in only 5 to 6 minutes with solvent and ten to fifteen minutes with water. In prior systems, the roll typically must be inefficiently scrubbed with brushes and rags.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

I claim:

1. A coating head device for coating an engraved surface on a coating cylinder of a printing press, where the coating cylinder has means to rotate on an axis, comprising:

(a) a main body, mounted parallel to the axis of the coating cylinder, having a longitudinal cavity for liquid, open to said coating cylinder and having a sealing means to substantially seal said main body to said coating cylinder, said cavity having a supply chamber and a return chamber with an injection zone chamber disposed between and open to the supply chamber and the return chamber, said injection zone chamber providing for a liquid pressurizing zone within a portion of said cavity in said main body;

(b) said main body having means to provide liquid to a supply chamber in the longitudinal cavity;

(c) said main body having means to exhaust said liquid and air from said return chamber in the longitudinal cavity;

(d) said coating cylinder having an outer cylindrical surface; and (e) said injection zone chamber comprising a narrow open passageway connecting said supply chamber to said return chamber, adjacent said coating cylinder, said injection zone chamber having an inlet from the supply chamber and an outlet to the return chamber, said inlet and outlet having substantially equal and largest cross sectional areas within the injection zone chamber, said injection zone chamber smoothly narrowing to a point of least cross sectional area at a point substantially midway between the inlet and outlet, wherein said injection zone chamber is bounded on one side by a flat, planar surface on said main body that is parallel to a tangent of said cylindrical surface of said coating cylinder and parallel to the axis of said coating cylinder and bounded opposite the flat, planar surface by the outer cylindrical surface of said coating cylinder, said injection zone chamber being symmetric relative to the axis of the coating cylinder, said injection zone chamber providing means to initially provide compressive force to the liquid passing through the injection zone chamber that builds to a peak at the midway point of the injection zone chamber and then provides for a substantially equal decrease in compressive force.

2. The coating head of claim 1, wherein said sealing means includes at least a pair of doctor blades and end seals disposed on said main body to seal said coating head against said coating cylinder whereby liquid supplied by said means to provide liquid may be substantially kept from leaking from an interface created by said coating head and said coating cylinder.

3. The coating head of claim 2, wherein the end seals are substantially 100% wool felt and petroleum jelly.

4. The coating head of claim 1, wherein the means to provide liquid is a means to provide ink.

5. A coating head device for coating an engraved surface on a coating cylinder of a printing press, where the coating cylinder has means to rotate on an axis, comprising:

(a) a main body, mounted parallel to the axis of the coating cylinder, having a longitudinal cavity for liquid, open to said coating cylinder and having a sealing means to substantially seal said body to said coating cylinder, said cavity comprising a longitudinally disposed supply chamber, a longitudinally disposed return chamber, and a longitudinally disposed injection zone chamber disposed between and open to said supply chamber and said return chamber;

(b) said main body having means to provide liquid to said supply chamber in the longitudinal cavity;

(c) said main body having means to exhaust liquid and air from said return chamber in the longitudinal cavity;

(d) said coating cylinder having an outer cylindrical surface;

(e) said injection zone chamber having means to provide increased pressure of liquid flowing through said injection zone chamber at a substantially constant volumetric rate, said pressure peaking at a longitudinal center point of said injection zone chamber, said injection zone chamber comprising a narrow open passageway connecting said supply chamber to said return chamber, adjacent said coating cylinder, said injection zone chamber having an inlet and an outlet having substantially equal and largest cross sectional areas within the injection zone chamber, said injection zone chamber narrowing to a point of least cross sectional area at a point substantially mid way between the inlet and outlet, wherein said injection zone chamber is bounded on one side by a flat, planar surface on said main body that is parallel to a tangent of said cylindrical surface of the coating cylinder and parallel to the axis of the coating cylinder and bounded opposite the flat, planar surface by the outer cylindrical surface of said coating cylinder, said injection zone chamber being symmetric relative to the axis of the coating cylinder, said injection zone chamber providing means to initially provide compressive force to the liquid passing through the injection zone chamber that builds to a peak at the midway point of the injection zone chamber; and (f) said supply chamber and said return chamber each having substantially more volume than said injection zone chamber.

6. The coating head of claim 5, wherein the supply chamber and the return chamber are substantially half-circular in cross-section.

7. The coating head of claim 5, including at least a pair of doctor blades and end seals disposed on said main body to seal said coating head against said coating cylinder whereby liquid supplied by said means to provide liquid may be substantially kept from leaking from an interface created by said coating head and said coating cylinder.

8. A coating head device for use on a printing press having a coating cylinder with an engraved surface, where the coating cylinder has means to rotate on an axis, comprising:

(a) a main body, mounted parallel to the axis of the coating cylinder, having a longitudinal cavity, said cavity comprising a longitudinally disposed supply chamber, a longitudinally disposed return chamber and a longitudinally disposed injection zone chamber disposed between and open to said supply chamber and said return chamber;

(b) said supply chamber and said return chamber being substantially half-circular in cross section;

(c) said main body having means to provide liquid to said supply chamber in the longitudinal cavity;

(d) said main body having means to exhaust liquid and air from said outlet section in the longitudinal cavity;

(e) a sealing means comprising at least one pair of doctor blades disposed on said main body and at least two end seals disposed on said main body to seal said coating head against said coating cylinder;

(f) said coating cylinder having an outer cylindrical surface;

(g) said injection zone chamber having means to provide increased pressure peaking at a longitudinal center point of said injection zone chamber, said injection zone chamber comprising a narrow open passageway connecting said supply chamber to said return chamber, adjacent said coating cylinder, wherein said passageway is bounded on one side by a flat, planar surface on said main body that is parallel to a tangent of said cylindrical surface of the coating cylinder and bounded opposite the flat, planar surface by the outer cylindrical surface of said coating cylinder, said injection zone chamber having an inlet and an outlet having equal cross sections, said inlet and outlet having substantially equal and largest cross sectional areas within the injection zone chamber, said injection zone chamber narrowing to a point of least cross sectional area at a point substantially midway between the inlet and the outlet, said injection zone chamber betting symmetric relative to the axis of the coating cylinder, said injection zone chamber providing means to initially provide compressive force to the liquid passing through the injection zone chamber that builds to a peak at the midway point of the injection zone chamber; and (h) said supply chamber and said return chamber each having substantially more volume than said injection zone chamber.

9. A printing press apparatus comprising:

(a) a rotatable coating cylinder having an engraved surface, said engraved surface comprising a plurality of cells;

(b) a rotatable printing cylinder in rolling contact with said coating cylinder having a printing plate mounted thereon;

(c) a rotatable backing cylinder disposed adjacent said printing cylinder such that printing material may be fed through a slot created between said printing cylinder and said backing cylinder; and (d) a coating head device for coating said engraved surface on said coating cylinder comprising:

(i) a main body having a longitudinal cavity for liquid, open to said coating cylinder and a sealing means for substantially sealing said main body to said coating cylinder, said cavity having a supply chamber, and a return chamber, with an injection zone chamber disposed between and open to the supply chamber and the return chamber, said injection zone chamber providing for a zone pressurizing said liquid within a portion of said cavity in said main body;

(ii) said main body having means to provide liquid to said supply chamber in the longitudinal cavity; and (iii) said main body having means to exhaust said liquid and air from said return chamber in the longitudinal cavity;

(e) said coating cylinder having an outer cylindrical surface; and (f) said injection zone chamber comprising a narrow passageway between said supply chamber and said return chamber, adjacent said coating cylinder, wherein said passageway is bounded on one side by a flat, planar surface on said main body that is parallel to a tangent of said cylindrical surface of said coating cylinder and parallel to the axis of said coating cylinder and bounded opposite the flat, planar surface by the outer cylindrical surface of said coating cylinder, said planar surface parallel to a tangent of said outer cylindrical surface of said coating cylinder, said injection zone chamber having an inlet and an outlet having equal cross sections, said inlet and outlet having substantially equal and largest cross sectional areas within the injection zone chamber, said injection zone chamber narrowing to a point of least cross sectional area at a point substantially midway between the inlet and outlet, said injection zone chamber being symmetric relative to the axis of the coating cylinder, said injection zone chamber providing means to initially provide compressive force to the liquid passing through the injection zone chamber that builds to a peak at the midway point of the injection zone chamber.

10. The printing press of claim 9, wherein the sealing means includes at least a pair of doctor blades and end seals disposed on said main body to seal said coating head against said coating cylinder whereby liquid supplied by said means to provide liquid may be substantially kept from leaking from an interface created by said coating head and said coating cylinder.

11. The printing press apparatus of claim 10, wherein the sealing means includes end seals that are substantially 100% wool felt used in conjunction with petroleum jelly.

12. The printing press apparatus of claim 9, wherein the means to provide liquid is a means to provide ink.

13. A printing press apparatus comprising:

(a) a rotatable coating cylinder having an engraved surface, said engraved surface comprising a plurality of cells, the coating cylinder having means to rotate on an axis;

(b) a rotatable printing cylinder in rolling contact with said coating cylinder having a printing plate mounted thereon;

(c) a rotatable backing cylinder disposed adjacent said printing cylinder such that printing material may be fed through a slot created between said printing cylinder and said backing cylinder;

(d) a pump for supplying liquid to a coating head device; and (e) said coating head device for coating said engraved surface on said coating cylinder comprising:

(i) a main body having a longitudinal liquid cavity open to said coating cylinder and having a sealing means to substantially seal said main body to said coating cylinder, said cavity comprising a longitudinally disposed supply chamber, a longitudinally disposed return chamber and a longitudinally disposed injection zone chamber disposed between and open to said supply chamber and said return chamber;

(ii) said main body having means to provide liquid to said supply chamber in the longitudinal cavity, supplied by said pump;

(iii) said main body having means to exhaust liquid and air from said return chamber in the longitudinal cavity;

(iv) said injection zone chamber having means to provide increased pressure of liquid flowing through said zone at a substantially constant volumetric rate, said pressure peaking at a longitudinal center point of said injection zone chamber; and (v) said supply chamber and said return chamber each having substantially more volume than said injection zone chamber;

(vi) said coating cylinder having an outer cylindrical surface that has means to spin on an axis; and (vii) said injection zone chamber comprising a narrow passageway between said supply chamber and said return chamber, adjacent said coating cylinder, wherein said passageway is bounded on one side by a flat, planar surface on said main body that is parallel to a tangent of said cylindrical surface of said coating cylinder and parallel to the axis of the coating cylinder and bounded opposite the flat, planar surface by the outer cylindrical surface of said coating cylinder, said planar surface parallel to a tangent of said outer cylindrical surface of said coating cylinder, said injection zone chamber having equal cross sections, said inlet and outlet having a substantially equal and largest cross sectional areas within the injection zone chamber, said injection zone chamber narrowing to a point of least cross sectional area at a point substantially midway between the inlet and the outlet, said injection zone chamber being symmetric relative to the axis of the coating cylinder, said injection zone chamber providing means to initially provide compressive force to the liquid passing through the injection zone chamber that builds to a peak at the midway point of the injection zone chamber.

14. The printing press of claim 13, wherein said sealing means comprises at least a pair of doctor blades and end seals disposed on said main body to seal said coating head against said coating cylinder whereby liquid supplied by said means to provide liquid may be substantially kept from leaking from an interface created by said coating head and said coating cylinder.

15. A printing press apparatus comprising:

(a) a rotatable coating cylinder having an engraved surface and means to rotate on an axis, said engraved surface comprising a plurality of cells;

(b) a rotatable printing cylinder in rolling contact with said coating cylinder having a printing plate mounted thereon;

(c) a rotatable backing cylinder disposed adjacent said printing cylinder such that printing material may be fed through a slot created between said printing cylinder and said backing cylinder;

(d) a pump to supply liquid to a coating head device;

(e) said coating head device for coating said engraved surface on said coating cylinder comprising:

(i) a main body having a longitudinal cavity, said cavity comprising a longitudinally disposed supply chamber, a longitudinally disposed return chamber and a longitudinally disposed injection zone chamber disposed between and open to said supply chamber and said return chamber;

(ii) said supply chamber and said return chamber being substantially half-circular in cross section;

(iii) said main body having at least one orifice for supplying liquid to said supply chamber supplied by said pump;

(iv) said main body having means to exhaust liquid and air from said outlet section;

(v) a sealing means comprising at least one pair of doctor blades disposed on said main body and at least two end seals disposed on said main body to seal said main body of said coating head against said coating cylinder;

(vi) said injection zone chamber having means to provide increased pressure peaking at a longitudinal center point of said injection zone chamber;

(vii) said coating cylinder having an outer cylindrical surface; and (viii) said injection zone chamber comprising a narrow passageway between said supply chamber and said return chamber, adjacent said coating cylinder, wherein said passageway is bounded on one side by a planar surface on said main body that is parallel to a tangent of said cylindrical surface of said coating cylinder and parallel to the axis of the coating cylinder and bounded opposite the flat, planar surface by the outer cylindrical surface of said coating cylinder, said planar surface parallel to a tangent of said outer cylindrical surface of said coating cylinder, said injection zone chamber having an inlet and an outlet, said inlet and outlet having substantially equal and largest cross sectional areas within the injection zone chamber, said injection zone chamber narrowing to a point of least cross sectional area at a point substantially midway between the inlet and the outlet, said injection zone chamber being symmetric relative to the axis of the coating cylinder, said injection zone chamber providing means to initially provide compressive force to the liquid passing through the injection zone chamber that builds to a peak at the midway point of the injection zone chamber;

(ix) said supply chamber and said return chamber each having substantially more volume than said injection zone chamber.

* * * * *